United States Patent [19]

Loxham

[11] 4,018,081

[45] Apr. 19, 1977

[54] TESTING OF CIGARETTES

[75] Inventor: John Loxham, Bletchley, England

[73] Assignee: Molins Limited, England

[22] Filed: Nov. 10, 1975

[21] Appl. No.: 630,403

[30] Foreign Application Priority Data

Nov. 12, 1974 United Kingdom ..... 48841/74

[52] U.S. Cl. ..... 73/41

[51] Int. Cl.[2] ..... G01M 3/26

[58] Field of Search ..... 73/41, 45, 45.1, 45.2

[56] References Cited

UNITED STATES PATENTS

| | | | |
|---|---|---|---|
| 3,395,570 | 8/1970 | Kochalski | 73/45.2 |
| 3,488,994 | 1/1970 | Messervey | 73/45.2 |

*Primary Examiner*—S. Clement Swisher

*Attorney, Agent, or Firm*—Craig & Antonelli

[57] ABSTRACT

A device for testing the wrappers of cigarettes for leaks comprises a conveyor arranged to carry the cigarettes successively through a test region, means defining in the tests region a plurality of similar test chambers partly bounded by the respective cigarette wrapper, a source of pressure which communicates with each test chamber in turn at a first station in the test region to produce a predetermined initial pressure in each test chamber, and a pressure detector arranged to detect the pressure left in each test chamber in turn at a second station in the test region downstream of the first station.

20 Claims, 9 Drawing Figures

TESTING OF CIGARETTES

This invention relates to testing devices for testing the wrappers of cigarettes for leaks.

Such devices commonly comprise a conveyor which carries the cigarettes successively through a test region at which a difference in pressure between the interior and exterior of the cigarette is established to produce an air flow through the cigarette wrapper, and include a pressure detector to detect the presence of any cigarettes allowing an excessive leak.

According to one aspect of the present invention, the cigarette testing device includes means defining a similar test chamber for each cigarette during testing, the test chamber being partly bounded by the cigarette wrapper, and a source of pressure which is connected to each test chamber in turn at a first station to produce a predetermined initial pressure in each chamber, the pressure detector being arranged to detect the pressure left in each chamber at a second station downstream of the first station.

The basis of operation of this device is that the magnitude of the pressure in each test chamber (regardless of whether the pressure is above or below atmospheric), after the corresponding cigarette leaves the first station (i.e. after the pressure source is disconnected) progressively approaches atmospheric pressure as a result of leakage through the wrapper. The pressure left in the chamber when the cigarette arrives at the second station, which occurs after a predetermined interval of time, is dependent upon the condition of the wrapper; that it to say, a wrapper with a pronounced leak will result in a relatively low pressure being detected at the second station. Any cigarette which produces a pressure below a given limit may be automatically ejected.

The interval of time allowed for the decaying of pressure in the test chamber is preferably such as to give the maximum difference between the chamber pressure for a good cigarette and the chamber pressure for a just acceptable cigarette, the chamber pressure referred to here being the pressure detected at the second station.

The test chamber for each cigarette may surround the cigarette, in which case one or both ends of the cigarette should be exposed to atmospheric pressure or to some other predetermined pressure. Alternatively, the test chamber for each cigarette could comprise the interior of the cigarette together with an associated chamber (having a volume which is preferably at least of the same order as that of the cigarette) which is formed in the conveyor carrying the cigarettes during testing and which communicates with the interior of the associated cigarette; and the device includes end seals which restrict or prevent communication between the interior of the cigarette and atmosphere, the outer surface of the cigarette being exposed to the atmosphere.

According to a second aspect of this invention, a cigarette testing device (especially one which is basically in accordance with the first aspect of this invention) includes means for producing a pressure differential between the interior and exterior of each cigarette in turn, and a pressure detector arranged to respond to a test pressure which depends upon the degree of leakage of air through the cigarette wrapper, the pressure detector comprising a resiliently expandible bellows device the interior of which receives the test pressure.

The bellows may, for example, carry an electrical contact member which engages a fixed contact or is disengaged from a fixed contact when the pressure to be monitored lies beyond a predetermined limit.

The bellow should preferably have as small a volume as possible. For example, it may consist of two thin metal discs or similar diameter having their peripheries secured together and each having a slightly dished shape so that their central portions are spaced apart, the test pressure being admitted to the space between the disc via a passageway through a fixed member to which the central portion of one of the discs is secured.

In a preferred arrangement the bellow is arranged to monitor a succession of cigarettes, and the interior of the bellows, before being connected to a conduit leading to each cigarette to be tested, is connected to a preparatory source of pressure of a magnitude corresponding approximately to that produced by a cigarette which is just satisfactory. Preferably there are two such bellows which are arranged to monitor alternate cigarettes; each bellows, before being connected to the conduit leading to a given cigarette, may be connected to a peparatory source of pressure via a conduit adjacent to the immediately preceding cigarette.

According to a third aspect of this invention, a device for testing the wrappers of cigarettes for leaks (especially one in accordance with the first apsect of this invention) includes a first source of pressure which is connected to a chamber formed around each cigarette in turn, or is connected to one end of each cigarette in turn, to produce a pressure differential between the interior and exterior of each cigarette in turn, and a pressure detector arranged to respond to a test pressure which depends upon the degree of leakage of air through the cigarette wrapper, characterised by a second source of pressure which is arranged to communicate with the pressure detector between successive periods of time during which the pressure detector operates in response to the test pressure received from successive cigarettes, the second source of pressure being of a smaller magnitude than the first source of pressure.

In place of the bellows it is possible to use a single flexible diaphragm attached around its circumference to a rigid support.

Examples of cigarette testing devices according to this invention are shown in the accompanying drawings. In these drawings.

Figure 1:
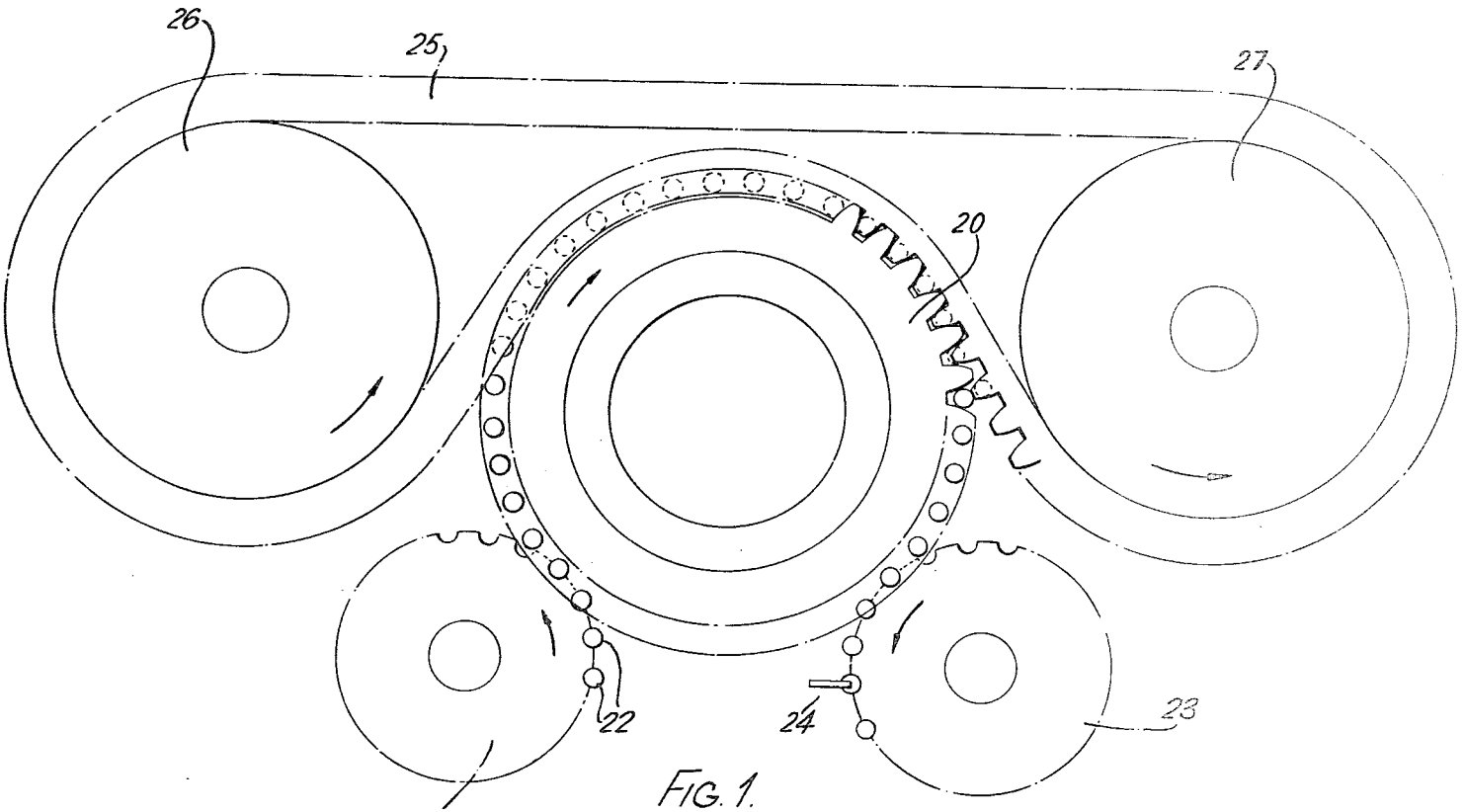
FIG. 1 is a partly sectioned side elevation of the testing device.

As shown in FIG. 1, the testing device includes a testing drum 20, a transfer roller 21 which delivers a stream of sideways-moving cigarettes 22 to the testing drum 20, and a transfer roller 23 which receives the cigarettes from the testing drum 20 after testing. Any cigarettes which are found faulty are automatically ejected by an axially directed air jet delivered by a pipe 24. Satisfactory cigarettes are received from the transfer roller 23 by a further conveyor (not shown).

Testing is carried out with the aid of a number of closure members forming part of a conveyor 25 which passes around idler pulleys 26 and 27. The conveyor 25 is driven by gears on the testing drum 20 which mesh with gear teeth on the individual closure members on the conveyor 25, as will presently be described.

Figure 3:
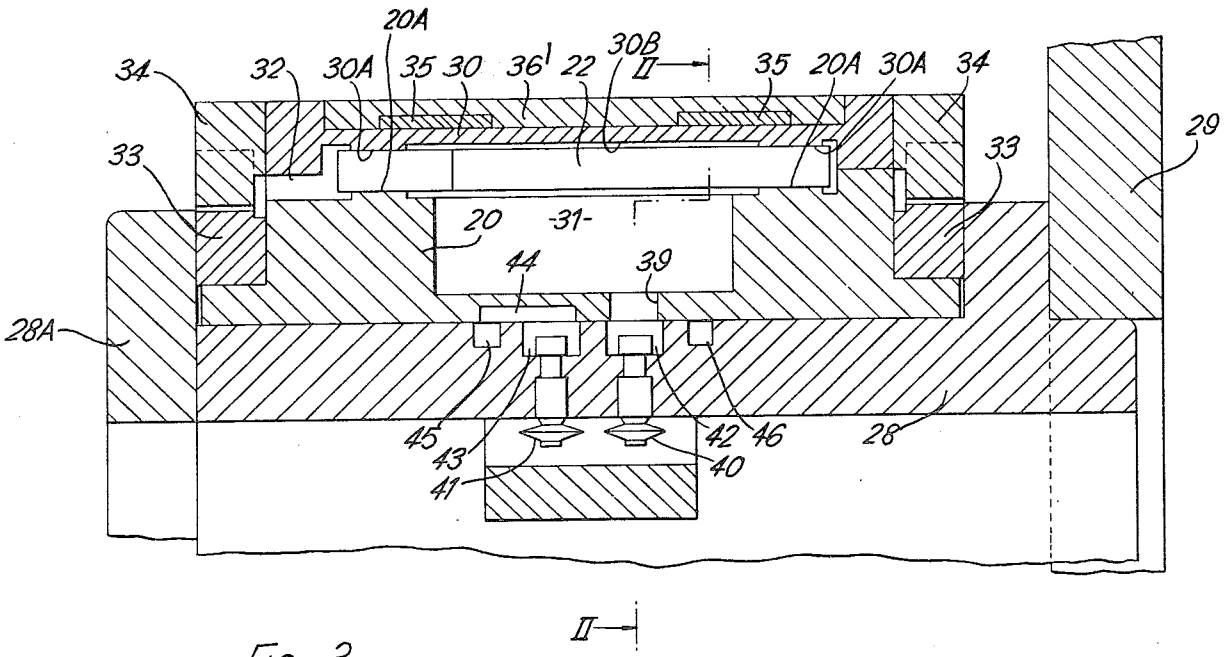
FIG. 3 is a cross-section on the line III—III in FIG. 2.

As shown in FIG. 3, the testing drum 20 is mounted for rotation around a stationary sleeve 28 which is carried by a frame 29. An end ring 28A (omitted from FIG. 1) is secured to the sleeve 28 to hold the drum on the sleeve.

During testing, each cigarette is enclosed between the drum 20 and a closure member 30, being supported near its ends by semi-cylindrical recessed portions 20A and 30A respectively on the drum 20 and closure member 30. Furthermore, the conveyor and closure member together define a test chamber 31 which is formed mainly by a recess in the drum adjacent to each cigarette and partly by a recess 30B in the closure member, so that the chamber extends all the way around the periphery of the cigarette. The sides of the closure members 30 bear partly on resilient sealing strips 20B set into axial grooves in the drum (see FIG. 2).

One end of the cigarette being tested (i.e. the left-hand end as seen in FIG. 3) is exposed to atmosphere through a channel 32 formed between the drum and the closure member. The other end of the cigarette is closed by close-fitting parts of the drum and closure member, but it could alternatively also be exposed to atmosphere. The cigarette preferably lies with its filter end adjacent to the channel 32, as shown in FIG. 3.

Figure 2:
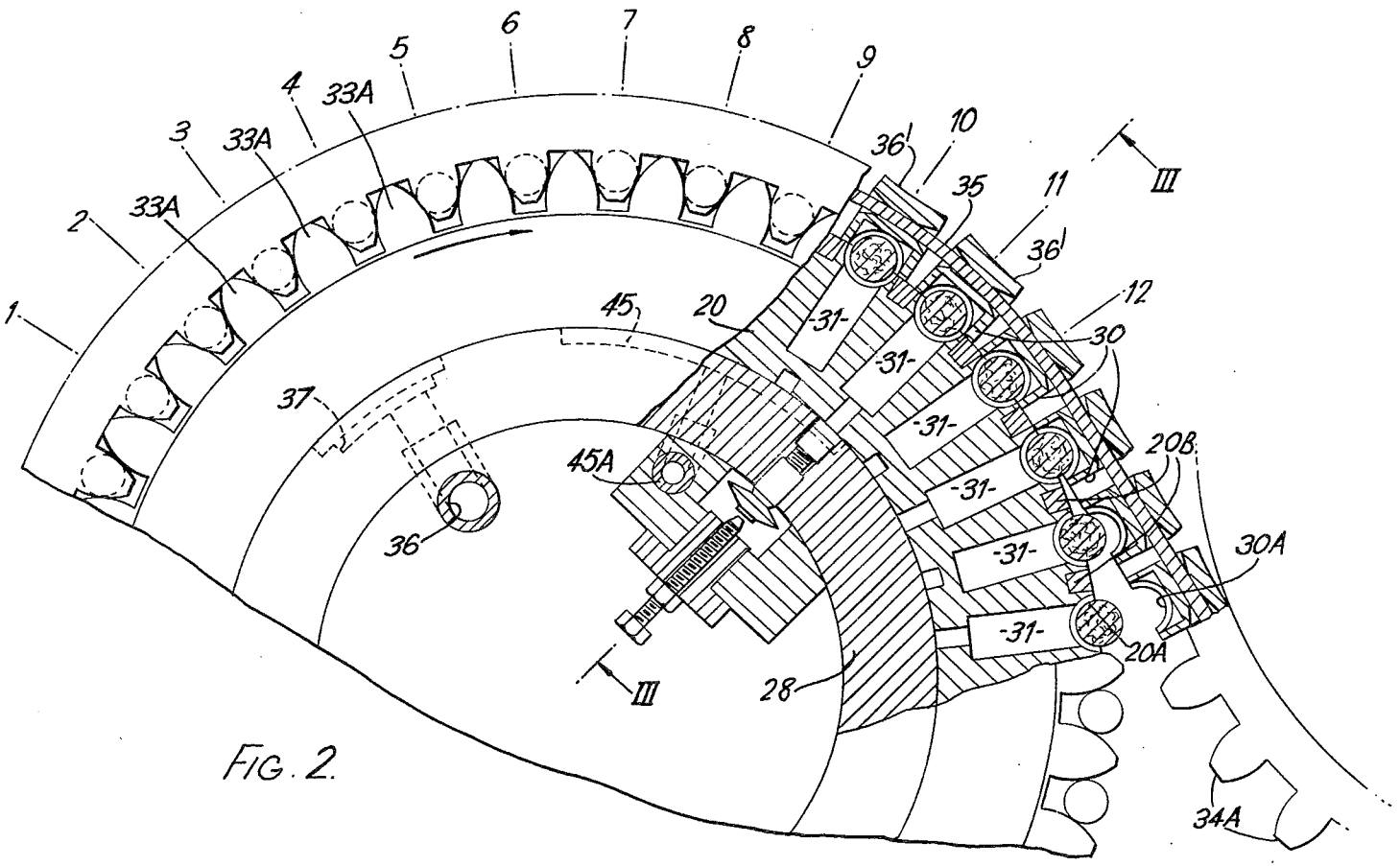
FIG. 2 is a partly sectioned enlargement of part of FIG. 1, the sectioned part being taken on the line II—II in FIG. 3.

Two gear rings 33 are mounted on opposite ends of the drum 20 and are formed with gear teeth 33A, as shown in FIG. 2. These gear teeth mesh with gear teeth 34A formed on end parts 34 secured to the closure members 30, each part 34 at each end of the drum having one gear tooth 34A; the pitch line of the mating teeth is at a radius such that the axes of the cigarettes being inspected pass through it. The closure parts are carried by two parallel bands 35, each closure part being held on the bands 35 by means of a cap 36' which is secured to the closure part 30 so as to grip the bands. Thus the conveyor comprising the closure parts and the bands 35 is driven by the drum at a speed equal to the peripheral speed of the drum, with each closure part in alignment with a cigarette during testing.

Each cigarette is tested by connecting the corresponding test chamber 31 to a source of suction pressure including a pipe 36 (see FIG. 2) which opens out into a recess 37 in the surface of the sleeve 28; the recess 37 serves as a test pressure manifold. At the bottom of each chamber 31 there is a slot 39 through which the chamber 31 communicates with the manifold 37. Alternate slots 39 are in two different planes normal to the axis of the drum, in alignment with two bellows devices 40 and 41 respectively. FIG. 3 shows one of the slots 39 in alignment with the bellows device 40.

Figure 5A:
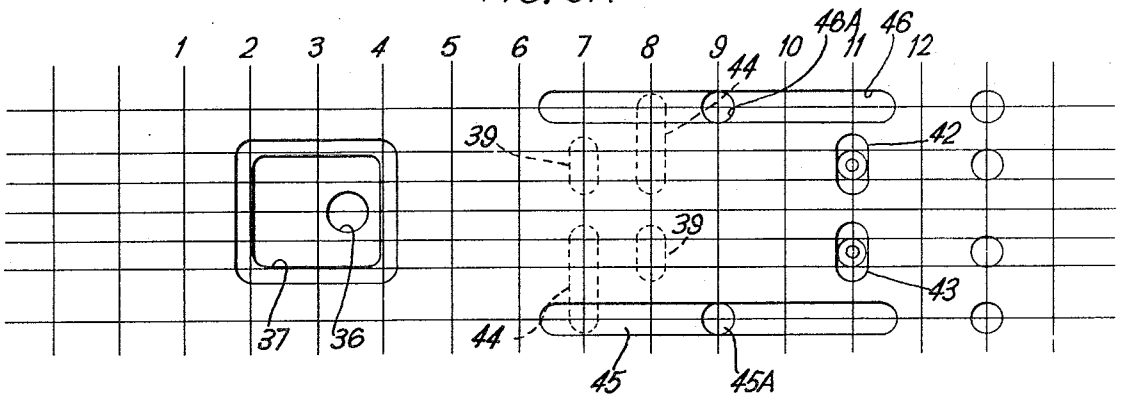
FIGS. 5A and 5B are flat developed views showing the interface between the internal surface of the testing drum and the external surface of the stationary sleeve member inside the drum.
Figure 5B:
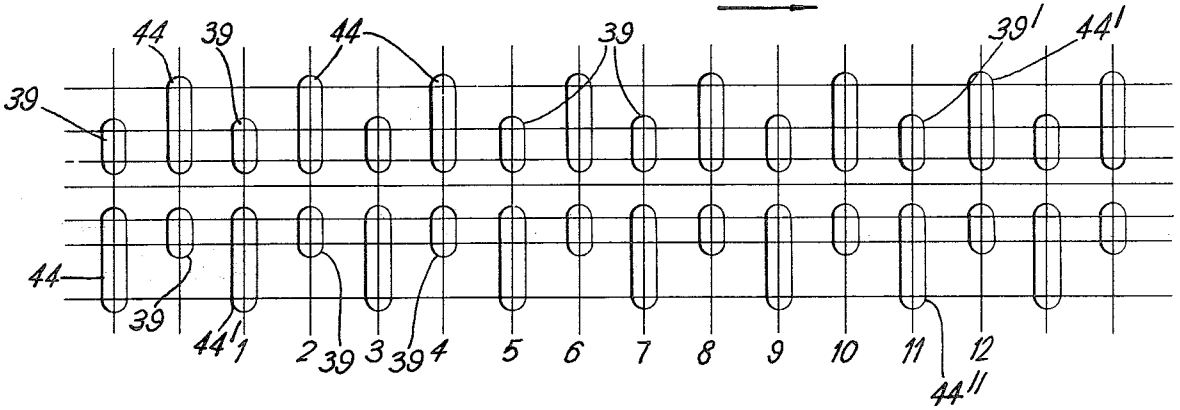

In order to show the sequence of operations, FIGS. 5A and 5B and also FIG. 2 show the positions of twelve cigarettes by means of radial lines 1 to 12 passing through the cigarettes, line 11 being in effect the monitoring station at which each cigarette in turn is connected to one or other bellows device 40 or 41. FIG. 5A is a flat-developed view of the relavent part of the external surface of the sleeve 28, while FIG. 5B is a flat-developed view of part of the internal surface of the drum. The lines 1 to 12 correspond to the positions of radial lines 1 to 12 in FIG. 2.

As shown particularly in FIG. 5A and 5B, the test pressure manifold 37 spans approximately the lines 2 to 4 and has a width such that each slot 39 can communicate with the manifold 37 to transmit the test suction to the associated test chamber 31. Suction stops being applied to each test chamber 31 after the slot 39 has passed line 4. At line 11 each slot 39 in turn communicates with a passage 42 leading to the bellows device 40, or with a pasage 43 leading to the bellows device 41, as the case may be. The construction of each bellows device is shown particularly in FIG. 4 and is described further on.

It will be understood that FIG. 5A and 5B should be superimposed to be fully understood. For convenience, two slots 39 are shown in dotted outline in FIG. 5A. Also shown smilarly in dotted outline in that figure are two grooves 44 for adjacent cigarettes, these grooves 44 being shown more clearly in FIG. 3. Each groove 44 allows the corresponding bellows device to communicate with one or other manifold 45 or 46 which is connected via a conduit 45A or 46A to a source of suction of a lower magnitude than that supplied to the test suction manifold 37. For example, the test suction supplied to the manifold 37 may be approximately 125 mm water gauge, while the suction supplied to the manifolds 45 and 46 may, for example, be 50 mm water gauge. The suction supplied to the manifolds 45 and 46 serves to prepare the bellows devices for the monitoring operation. For this purpose, the suction pressure in the manifolds 45 and 46 should preferably be approximately equal to the suction pressure left in the test chambers 31 in the case of just satisfactory cigarettes. The figure of 50 mm water gauge is given as an example, and the actual figure required may be different, a suitable figure for any particular system can be derived by experiment.

Before each bellows device 40 or 41 is connected to a test chamber 31, it is prepared for the testing operation by being connected to the preparatory suction source in manifold 45 or 46 by the groove 44 adjacent to the preceding cigarette. Consider, for example, the testing operation of the cigarette shown at line 11, that is to say the cigarette which is being monitored by the bellows device 40 via passage 42. Before the slot 39' associated with that cigarette arrived at the passage 42, the groove 44' for the preceding cigarette, while it was in the region of line 11, transmitted the preparatory suction from the manifold 46 to the passage 42, thus preparing the bellows device 40. A corresponding sequence applies to the cigarettes which are monitored by the bellows device 41; in the position shown in FIG. 5B, the bellows device 41 is being connected to the preparatory suction manifold 45 via groove 44'' and passage 43 to prepare for monitoring of the cigarette at present at line 10.

In view of the preparation of each bellows device, for each monitoring operation, by means of the preparatory suction, the necessary movement of the bellows is minimised, so that the air flow into or out of the bellows necessary to bring the internal bellows pressure to the level existing in the chamber 31 is minimal. It should be noted that the volume of the air space in the bellows device taken together with the air space in the conduit in the sleeve 28 leading to the bellows is very much smaller than the column of the test chamber 31, for example is no more than approximately one hundredth the volume of the test chamber. Also, by mounting the bellows devices directly on the sleeve 28 (instead of locating them at a more remote position outside the drum) we have kept the length of the path from the test chamber to the bellows about as short as possible. Thus each bellows device can respond quickly and reliably to the pressures in the successive test chambers.

The volume of each test chamber is substantially greater than the internal volume of each cigarette. That is desirable because, if that were not the case, then the pressure in the test chamber would decay too rapidly and would make the timing of the monitoring of test chamber pressure (at the second station) too critical.

The manifolds 45 and 46 are shown of a length such that they span lines 7 to 11. As an alternative, they could be made shorter, for example so as to span only lines 10 and 11.

Figure 4:
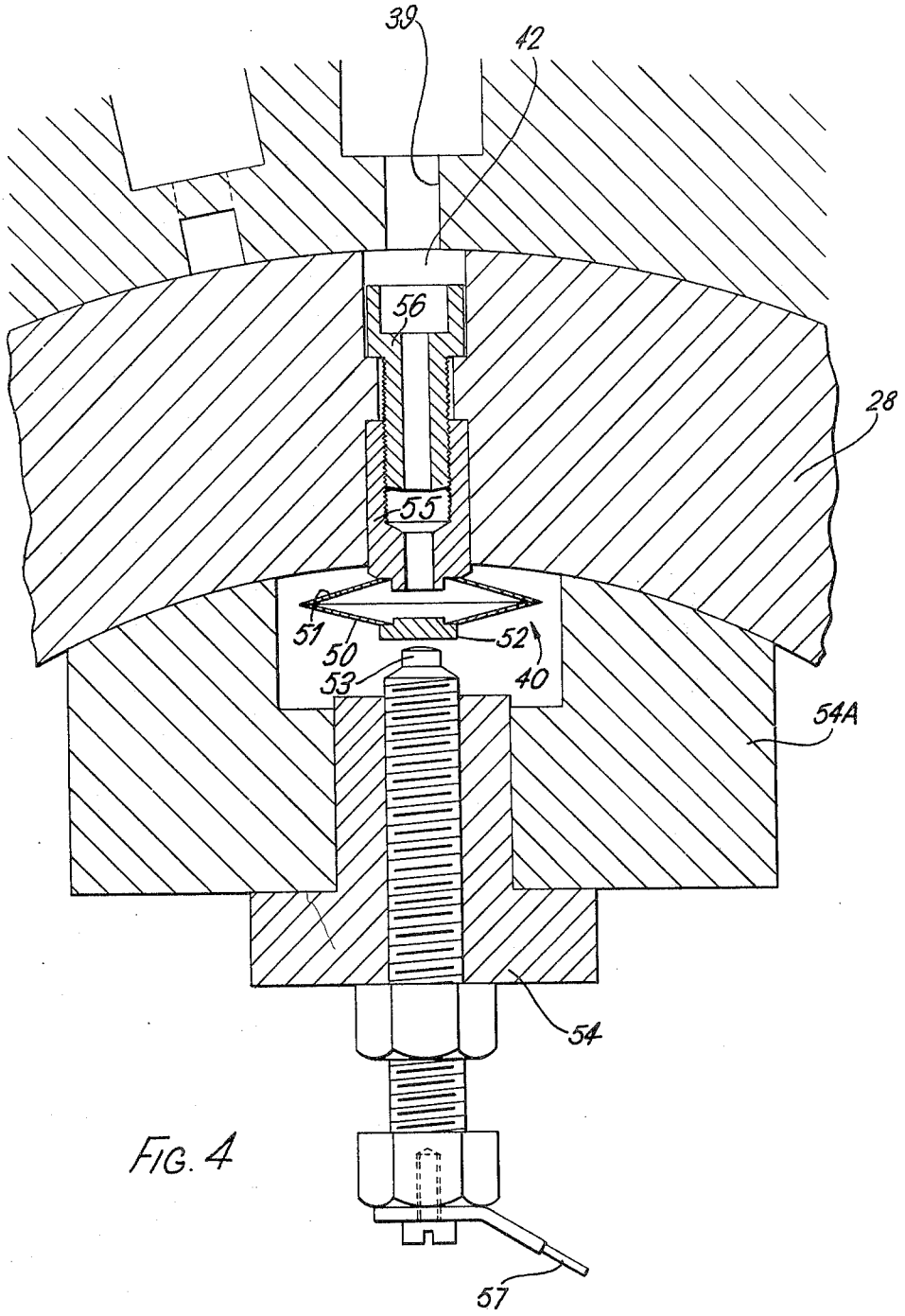
FIG. 4 is an enlargement of part of FIG. 2 showing the bellows.

FIG. 4 shows more clearly the construction of the bellows device 40; the bellows device 41 is similar.

As shown in FIG. 4, each bellows device comprises two frusto-conical discs 50 and 51 which are joined together at their peripheries and have their central portions spaced apart. The disc 50 carries an electrical contact 52 which is engageable with an adjustable fixed contact 53 screwed into an insulating sleeve 54 which is carried by a part 54A secured to the sleeve 28. The disc 51 is mounted on a tube 55 which is screwed onto a tube 56 in the manner shown, so that the bellows device is securely mounted in the sleeve 28. Thus the interior of the bellows formed by the discs 50 and 51 communicates with the passage 42 which, at the moment of time shown, communicates in turn with one of the slots 39.

The manner of operation is as follows. An acceptable cigarette, that is to say a cigarette with a wrapping which does not allow an excessive leagage flow through it, results in a suction pressure remaining in the corresponding test chamber 31 which is sufficient to hold the corresponding bellows in a compressed state with the contact 52 clear of the fixed contact 53. On the other hand, a cigarette which has a faulty wrapping allows the suction pressure in the corresponding test chamber 31 to die away to an extent sufficient to bring the contact 52 on the corresponding bellows into engagement with the fixed contact 53. This closes an electrical circuit including the sleeve 28 and a lead 57, whereupon a fault signal is produced which results in the faulty cigarette being ejected by an air jet directed from the pipe 24 (FIG. 1) as already mentioned.

Each bellows disc may be made from heat-treated beryllium copper of 0.015 mm thickness, the disc diameter being for example 12.5 mm.

Figure 6:
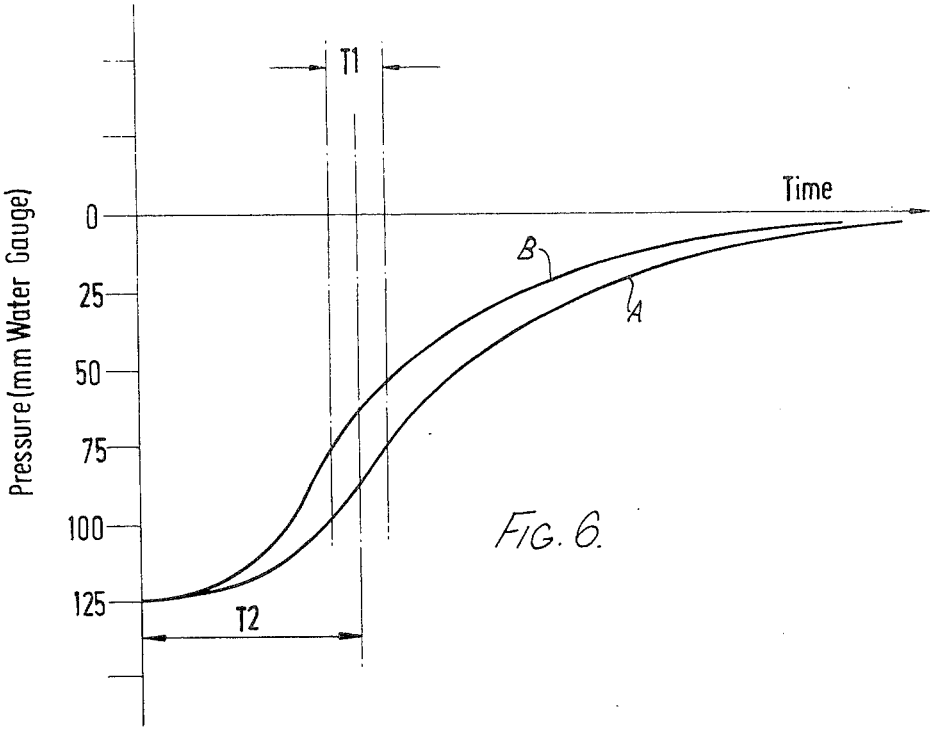
FIG. 6 is a graph showing the decay of pressure in the bellows for different cigarettes.

The time interval allowed for the suction pressure in each chamber 31 to die away before it is monitored is determined as follows. For any given type of cigarette, test equipment is used to plot the pressure in the test chamber at various time intervals after the test pressure source has been disconnected. A typical pressure-time curve for a good quality cigarette is shown in FIG. 6 as the curve A. Similarly the pressure-time curve is plotted for a just acceptable cigarette, that is to say a cigarette which allows a leakage flow through the wrapper which is only just acceptable; this is shown as the curve B in FIG. 6. It will be seen, from the example shown, that the difference between the curves A and B is greatest over the time span shown as T1, the midpoint of this time span being after a time interval T2. From this curve, it will be clear that monitoring can take place anywhere during the time period T1, and is ideally set to take place after a time interval T2 to allow a tolerance each way in the timing of the monitoring operation.

Different cigarettes may require a different time interval before monitoring, for example cigarettes made with a wrapper paper of different basic porosity. The time interval may be adjusted by forming recess 37 as a circumferentially adjustable insert; alternatively a replaceable insert may be used, different inserts having recesses with differently positioned downstream boundaries. Alternatively, different cigarette characteristics may be taken into consideration by adjusting the value of the test pressure source.

The semi-cylindrical parts 20A and 30A on the drum and closure members should preferably form a substantially airtight seal around each end of the cigarette; to this end the parts 20A and 30A could be fitted with flexible or inflatable inserts or other means for lightly engaging the cigarettes. However, it may be possible to allow slight clearance between the parts 20A and 30A and the cigarettes (thus avoiding any risk of damaging the cigarette), but in that case compensation is preferably provided for the leakage through the seals. This may be achieved in the following way. Before test suction is transmitted to each test chamber 31 from the manifold 37, suction is transmitted to each chamber 31 for a short period via a restrictor, and the resulting suction pressure in the chamber 31 (the value of which will depend upon the leakage through the seals) is used as a compensating pressue which is admitted to a chamber formed around the bellows 40 and 41.

The gap between the contact 52 on each bellows and the adjacent fixed contact 53 may, for example, be approximately 0.010 mm when the preparatory suction (e.g. 50 mm water gauge) is applied to the bellows.

Figure 4A:
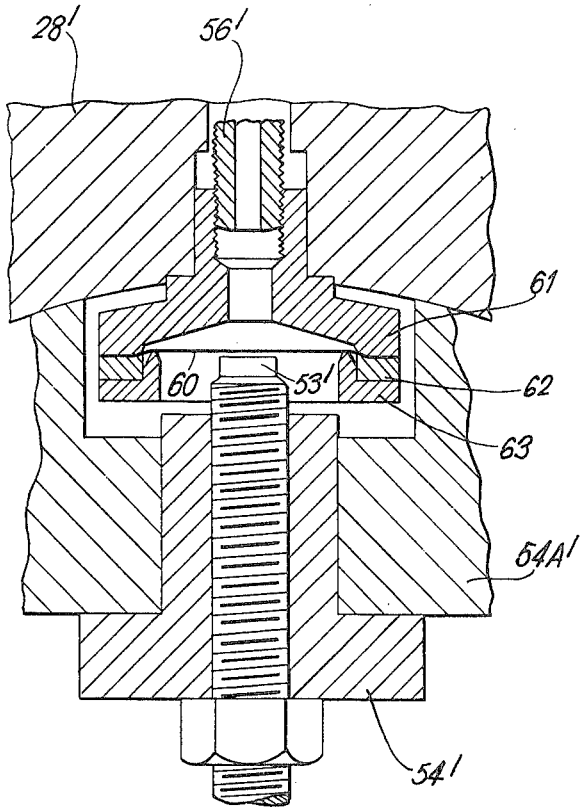
FIG. 4A shows a modification of the arrangement shown in FIG. 4.

FIG. 4A shows a modification of FIG. 4 in which the bellows is replaced by a flexible diaphragm 60. Parts which are similar or substantially similar to those shown in FIG. 4 have the same reference numerals with the addition of a dash.

The periphery of the diaphragm 60 is clamped against a rigid annular support 61 by a clamping ring 62. During assembly, the clamping is carried out to the unstrained diaphragm, after which a tensioning ring 63 is secured against the ring 62, and it deflects the diaphragm upwards, as shown, to tension it.

The diaphragm may be of thin sheet metal (for example, heat-treated beryllium copper of about 0.010 mm thickness) or it may be of a flexible plastic material (for example that known by the trade name Melinex) with a coating of silver or some other electrically conducting material on one side. The diaphragm is permanently spaced from the screw-threaded metal member 53', and there is a control circuit which is arranged to respond to the capacitance between the diaphragm and the member 53'. This capacitance may, for example, be connected into one arm of a control circuit which has another arm including an adjustable capacitance unit, the arrangement being such that the circuit emits a reject signal when the capacitance between the diaphragm and the member 53' is greater than that of the adjustable unit. The threshold pressure (i.e. the pressure level in the test chamber below which a cigarette is ejected) can be adjusted by adjustment of the adjustable capacitance unit.

It will be understood that a bellows such as that shown in FIG. 4 could similarly be used as a variable capacitance unit, with the part 52 remaining permanently spaced from the member 53.

In order to shorten still further the distance between the test chamber and the bellows or other pressure detecting device, each bellows device or other pressure monitory device (e.g. a diaphragm like that shown in FIG. 4A) may be mounted entirely or substantially entirely within a bore in the sleeve 28.

Figure 7:
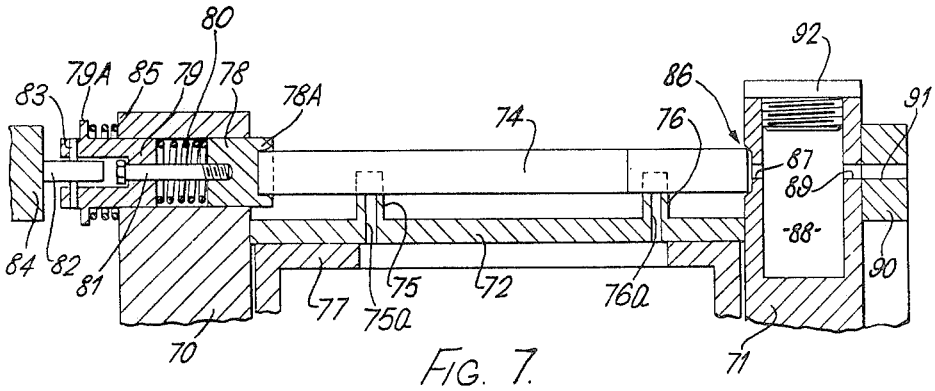
FIG. 7 is a diagrammatic sectional view of another different testing device.

FIG. 7 is a diagrammatic sectional view of another different testing device.

The testing device shown in FIG. 7 includes a drum comprising flanges 70 and 71 with an interposed sleeve member 72. Cigarettes 74 are delivered to the drum (for example, by a transfer drum like the drum 22 in FIG. 1), each being received in part-cylindrical recesses formed in radially projecting parts 75 and 76 on the sleeve member 72. Suction is supplied through passages 75A and 76A in the parts 75 and 76 to hold the cigarettes on the drum; appropriate timing of the application of suction is achieved by a stationary sleeve valve 77 in the drum.

The flange 70 is formed with a number of circumferentially spaced axial bores containing end sealing plungers 78 to close the adjacent end of each cigarette during testing. Each plunger 78 has a recessed outer end 78A to receive the end portion of the associated cigarette, the recess having a parallel inner portion (which fits closely around the cigarette) and a flared outer portion to facilitate entry of the cigarette into the recess.

Movement of each plunger 78 is controlled by a further plunger 79 via a spring 80 and a screw 81. The screw engages in the plunger 78 and allows the plunger 79 to move relative to it up to a predetermined maximum distance from the plunger 78. The spring ensures that there is a practical limit to the force that the plunger can apply to the plunger 78 and hence to the cigarette.

A roller 82 is rotatably mounted on each plunger 79 by means of a pin 83 and is urged against a cam 84 by a compression spring 85 acting between the flange 70 and a flange 79A on the plunger 79. The cam extends alongside part of the path of travel of the plungers and is so shaped that each plunger is able to be retracted into the flange 70 by the spring 85 prior to the arrival of the cigarette, is then pushed towards the cigarette (to the position shown) in preparation for the testing operation, and is then again retracted to allow the cigarette to be delivered from the drum after testing.

The right-hand end of each cigarette (preferably the filter end) is pressed into a conical recess 86 in the flange 71 by the plunger 78. At the bottom of each recess 86 there is an aperture 87 leading to a cylindrical chamber 88 which is closed at its outer end by a plug 92. An aperture 89 extends between the chamber 88 and the adjacent end face of the drum against which stationary arcuate pad 90 is passed. The pad 90 has an arcuate slot 91 which communicates with the aperture 89 during a predetermined angle of rotation of the drum for the purpose which will now be described.

Each chamber 88, together with the interior of the associated cigarette, forms the test chamber by means of which the cigarette is tested in accordance with this invention. That is to say, each chamber 88 (and the interior of the cigarette) is pressurized at a first station via the slot 91. Rotation of the drum past the slot 91 then disconnects the chamber 88 from the pressure source (which is preferably suction) and the pressure in the chamber then begins to die away as a result of leakage through the cigarette wrapper; during this time the aperture 89 is closed by a non-slotted part of the pad 90. Finally, at a second station the aperture 89 is connected to a pressure detector (not shown) via another slot in the pad 90; the pressure detector is preferably as close as possible to the drum to minimise the length (or, more specifically, the internal volume) of the conduit connecting the pad 90 to the pressure detector.

The following modification is possible. The apertures 89 for alternate cigarettes may be at different pitch circles so that pressure left in their chambers 88 can be detected by two separate pressure detecting devices connected respectively to two different slots in the pad. In this case a common pressure source is preferably used, the pad 90 being formed with two separate slots 91 for communicating with alternate apertures 89. This allows the use of longer slots; the two slots of each pair may overlap circumferentially so that the pressure source and/or each pressure detector can be connected to each chamber 88 for a longer period of time.

Provision may be made (along the lines of the apparatus shown in FIGS. 1 to 5) for connecting the or each pressure detector, between tests, to a source of pressure corresponding approximately to that which is left in the chambers 88 at the second station in the case of cigarettes which are only just satisfactory, i.e. are close to the threshold.

Other known arrangements, for example flexible seals, may be used in place of the plunger 78 and conical recess 86 for forming seals at or near the ends of the cigarettes.

The volume of each chamber 88 may be adjustable (for example by use of differently shaped plugs 92) to allow for different cigarette characteristics, for example different wrapper paper porosities.

I claim:

1. A device for testing the wrappers of cigarettes for leaks, comprising a conveyor arranged to carry the cigarettes successively through a test region, means defining in the test region a plurality of similar test chambers partly bounded by the respective cigarette wrappers, a source of pressure which communicates with each test chamber in turn at a first station in the test region to produce a predetermined initial pressure in each test chamber, and a pressure detector arranged to detect the pressure left in each test chamber in turn at a second station in the test region downstream of the first station.

2. A device according to claim 1 in which the volume of each test chamber is substantially greater than the volume of each cigarette.

3. A device according to claim 2 in which each test chamber in turn is connected to the pressure detector, at the second station, by a conduit of which the internal volume, taken together with the internal volume of the pressure detector, is substantially less than the volume of each test chamber.

4. A device according to claim 1 including a second source of pressure which is of smaller magnitude than the first source of pressure and is arranged to communicate with the pressure detector between successive periods of time during which the pressure detector is connected to successive test chambers.

5. A device according to claim 4, in which alternate cigarettes are arranged to be tested by means of two separate pressure detectors and in which there is a conduit adjacent to each cigarette which is arranged to provide communication between the second source of pressure and the pressure detector which is about to be connected to the test chamber associated with the immediately following cigarette.

6. A device according to claim 4 in which the magnitude of the second source of pressure is approximately equal to the pressure that exists in the test chamber at the second station in the case of cigarettes which are only just satisfactory.

7. A device according to claim 1 in which the test chamber for each cigarette surrounds the wrapper of the cigarette.

8. A device according to claim 7 in which the conveyor which carries the cigarettes during testing is a drum and in which each test chamber is defined partly by closure members on an endless band conveyor which extends part of the way around the drum.

9. A device according to claim 8 in which the closure members are arranged to expose at least one end of each cigarette to the atmosphere.

10. A device according to claim 8 in which the drum is formed which circumferentially spaced recesses forming the major parts of the test chambers.

11. A device according to claim 8 in which the or each pressure detector is mounted in a stationary sleeve within the drum and communicates with successive test chambers via radially extending passages in the drum.

12. A device according to claim 11 in which the or each pressure detector comprises a bellows device which expands or contracts in accordance with the pressure existing in successive test chambers at the second station.

13. A device according to claim 11 in which the or each pressure detector comprises a flexible diaphragm which is fixed at its periphery end and is exposed on one side to the pressure existing in successive test chambers at the second station.

14. A device according to claim 13 in which the pressure detector forms part of a variable capacitance.

15. A device according to claim 8 in which the endless band conveyor is driven by gear teeth on the drum engaging gear teeth on the closure members.

16. A device according to claim 8 in which each closure member has semi-cylindrical recesses at each of its ends which cooperate with semi-cylindrical recesses in the drum to form seals around the ends of the associated cigarette.

17. A device for testing the wrappers of cigarettes for leaks, including a first source of pressure which is connected to a chamber formed around each cigarette in turn, or is connected to one end of each cigarette in turn, to produce a pressure differential between the interior and exterior of each cigarette in turn, and a pressure detector arranged to respond to a test pressure which depends upon the degree of leakage of air through the cigarette wrapper, characterised by a second source of pressure which is arranged to communicate with the pressure detector between successive periods of time during which the pressure detector operates in response to the test pressure received from successive cigarettes, the second source of pressure being of a smaller magnitude than the first source of pressure.

18. A device according to claim 17 in which the magnitude of the second source of pressure corresponds approximately to the test pressure which is received by the pressure detector in the case of cigarettes which are only just satisfactory.

19. A device for testing the wrappers of cigarettes for leaks, comprising a conveyor arranged to carry the cigarettes successively through a test region, means in the test region for bringing the wrapper of each cigarette in turn into communication with a test chamber, means for connecting the test chamber to a source of pressure at a first moment of time during testing, and means for connecting the test chamber to a pressure detector at a second moment of time during testing, subsequent to the first moment of time, whereby the pressure left in the test chamber after leakage of air through the wrapper of the cigarette under test is detected.

20. A device for testing the wrappers of cigarettes for leaks, comprising a conveyor arranged to carry the cigarettes successively through a test region, a pressure detector, means for connecting the pressure detector to a source of pressure at a first moment of time, and means for bringing said pressure detector into communication with the wrapper of a cigarette to be tested at a second moment of time immediately after said first moment of time, whereby the pressure left in said pressure detector after leakage of air through the wrapper of the cigarette under test is detected.

* * * * *